US005248288A

United States Patent [19]

Kamiya et al.

[11] Patent Number: 5,248,288

[45] Date of Patent: Sep. 28, 1993

[54] APPARATUS FOR CHANGING WORK HOLDER IN TRANSFER PRESS

[75] Inventors: Fujimaro Kamiya, Suita; Masahiro Yamamoto, Sakai; Masumi Notsu, Toyonaka, all of Japan

[73] Assignee: Hitachi Zosen Corporation, Osaka, Japan

[21] Appl. No.: 831,113

[22] Filed: Feb. 4, 1992

[30] Foreign Application Priority Data

Mar. 29, 1991 [JP] Japan ..... 3-19832[U]
Mar. 30, 1991 [JP] Japan ..... 3-020265[U]

[51] Int. Cl.[5] ..... B23Q 3/155

[52] U.S. Cl. ..... 483/28; 72/405; 72/446; 83/563

[58] Field of Search ..... 483/28, 29, 902; 72/405, 446, 448; 83/563

[56] References Cited

U.S. PATENT DOCUMENTS 4,424,742 1/1984 Yamashita ..... 72/448 X
4,807,456 2/1989 Shiraishi et al. ..... 72/405
4,866,974 9/1989 Shiraishi et al. ..... 72/405
4,970,888 11/1990 Shiraishi et al. ..... 72/405
5,097,695 3/1992 Bezezniak ..... 72/405

*Primary Examiner*—Z. R. Bilinsky
*Attorney, Agent, or Firm*—Joseph W. Farley

[57] ABSTRACT

An apparatus for changing workpiece holders in a transfer press. An attachment 90 having suction cups 10 is removably attached to a cross-bar 8. The attachment 90 is supported on a attachment support base 19 disposed in a lower die 2a–2e. A movable upright support 12 which is movable between the attachment support base 19 and the cross-bar 8 is disposed on a die change truck 4. An attachment bearer 17 having a holding device 16 capable of holding the attachment 90 is provided on the top end of the movable upright support 12. The attachment 90 which has been supported on the attachment support base 19 is, in turn, held in position by the holding device 16 of the movable upright support 12, and then through movement of the movable upright support 12 the attachment 90 is transferred to the position of the cross-bar 8 for being fitted on the cross bar 8. Change of suction cups 10 is performed simply through attachment 90 changing. Thus, change of workpiece holders in connection with work change is automatized.

12 Claims, 12 Drawing Sheets

APPARATUS FOR CHANGING WORK HOLDER IN TRANSFER PRESS

FIELD OF THE INVENTION

The present invention relates to an apparatus for changing a workpiece holder in a transfer press and, more particularly, to a changing apparatus for use in connection with a die change in such press at each time of a workpiece change for simultaneously changing a workpiece holder fitted with workpiece holding elements.

BACKGROUND OF THE INVENTION

In known transfer presses a plurality of cross-bars are arranged in rectangular relation to feed bars for transferring workpieces, each cross-bar having workpiece holding elements, such as suction cups, attached directly thereto.

In such transfer press, when changing dies in connection with workpiece changing, a die change truck is employed for transferring dies to and from the press. In this conjunction, the cross-bar to which are attached the workpiece holding elements is dismounted from the feed bar and placed on the die change truck for being transferred outward from the press. The cross-bar, after being reloaded with holding elements corresponding to the new workpieces, is transferred together with new dies to the press. In this case, it is usual that the cross bar is manually mounted on the feed bar.

However, each cross-bar is of considerable weight because it usually carries a plurality of workpiece holding elements, and therefore it is a very troublesome and time-consuming operation to mount such a heavy cross-bar manually in position.

SUMMARY OF THE INVENTION

In view of this fact, it is a primary object of the invention to provide an apparatus for changing a workpiece holder in a transfer press wherein workpiece holding elements are attached to a cross-bar through an attachment in such a manner that the attachment, fitted with the workpiece holding elements, is automatically mounted to the cross-bar, whereby the foregoing drawback can be eliminated.

In order to accomplish this object, according to the invention there is provided a workpiece holder changing apparatus in a transfer press, said press including a die change truck movable between a press line and a location external thereof while being loaded with die means, a cross-bar mounted to feed bars shiftable along the press line, and a workpiece holder mounted to the cross-bar, said changing apparatus comprising:

a workpiece holding attachment including workpiece holding means and a mounting member to which the workpiece holding means is mounted;

an attachment support base provided on said die means for supporting said mounting member of said workpiece holding attachment;

a movable upright support disposed on said die change truck and movable between a position corresponding to said attachment support base and a position corresponding to said cross-bar;

an attachment bearer mounted to the movable upright support at a top end portion thereof; and means provided on said attachment bearer for holding said workpiece holding attachment in position on said attachment bearer.

According to this arrangement, the workpiece holding means, together with new dies, may be fitted in position in the following manner. When the die change truck is moved onto the press line, the movable upright support is first moved to the position corresponding to the attachment support base, and the attachment which has been supported on the attachment support base is placed on the attachment bearer for being held in position thereon. Then, the movable upright support is moved to cause the attachment bearer to be carried away from the attachment support base until the attachment reaches a position opposite to the cross-bar, the movable upright support being then stopped. The feed bars are then shifted to allow the cross-bar to be fitted with the attachment, whereupon the attachment bearer is relieved of the condition of holding the attachment and moved away from the attachment.

Therefore, according to the invention, wherein the cross-bar and workpiece holding means, which have conventionally been of an integral unity, are arranged into separate units so that the workpiece holding means can be readily fitted on the cross-bar by utilizing a separate attachment, it is possible to change workpiece holding means only by changing the attachment which is compact and light in weight. Fitting of the attachment in position can be automatically carried out by moving the movable upright support to actuate the attachment bearer, and the attachment itself can be readily moved to a fitting position. This eliminates the necessity of allowing for some surplus shift stroke with respect to the feed bars. Further, fitting of the attachment on the cross-bar is carried out at a position spaced from the attachment support base in the die through movement of the movable upright support and, therefore, die change can be carried out along with attachment fitting.

DESCRIPTION OF THE PREFERRED EMBODIMENT

Figure 11:
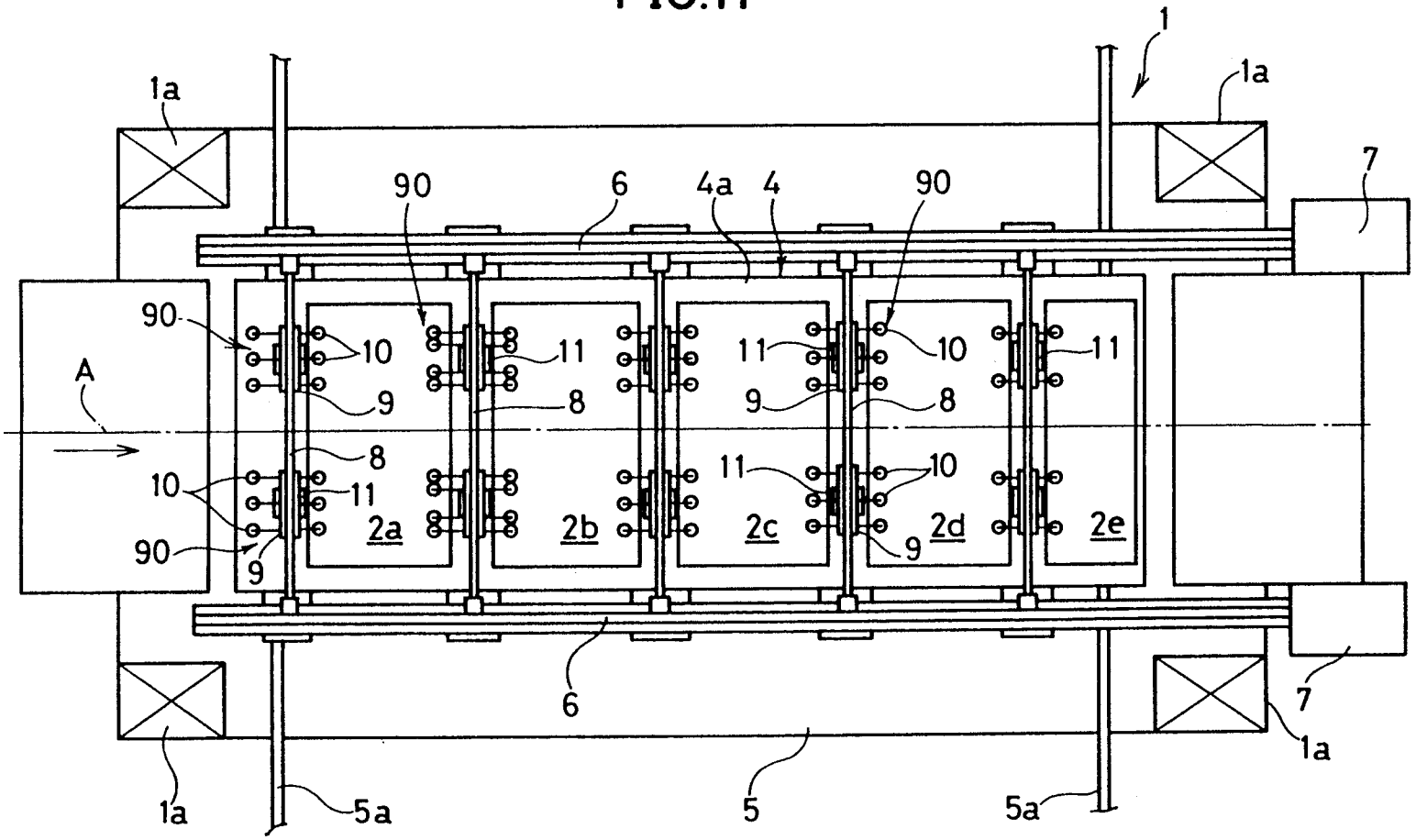
FIG. 11 is a plan view showing the entirety of a press line in a transfer press incorporating the concept of the invention.

As FIG. 11 shows, between uprights 1*a* of a transfer press 1, a plurality of lower dies 2*a*–2*e* are arranged on a bolster plate 4*a* of a die change truck 4 at given intervals along a press line A. During the process of die changing, upper dies are placed on the lower dies 2*a*–2*e*. The die change truck 4 is movable outward of the press 1 by being guided along rails 5*a* laid on a bed 5. A pair of feed bars 6 are disposed at opposite sides of the die change truck 4 as viewed in the direction of the press line A, the feed bars 6 being adapted to be driven by a feed-bar driving device 7 disposed at the work discharge end side for reciprocation in the direction of the press line A and for upward and downward movement.

A plurality of cross-bars 8 extend transversely between the feed bars 6 and are rotatable about their respective axes, each cross-bar 8 being fitted with a workpiece holding attachment 90 at a position corresponding to the workpiece. The attachment 90 includes downward facing suction cups 10 and a mounting member 9 to which the suction cups 10 are mounted. The suction cups 10 hold the upper surface of the workpiece under suction and progressively deliver workpieces in response to aforesaid movement of the feed bars.

On the die change truck 4, between individual lower dies 2*a*–2*e* and between the die 2*a* at the inlet side and the workpiece entry position, attachment changing apparatuses 11 for transfer of the attachment 90 between the cross-bar 8 and the die change truck 4 at each time of die changing are arranged in corresponding relation to individual attachments 90.

Each attachment changing apparatus 11 (FIG. 1) includes a movable upright support 12 extending vertically from a base plate 4*b* of the die change truck 4, a support shifting device 14 operative to force the movable upright support 12 to make a parallel move toward and away from the lower dies 2*a*–2*e* through a parallel link mechanism 13, and an elevatable attachment bearer 17 mounted to the top end of an actuating rod 15*a* of an elevating cylinder device 15 provided in conjunction with the movable upright support 12. The attachment bearer 17 includes a holding device 16 for holding the mounting member 9 of the attachment 90. Each lower die 2*a*–2*e* on the die change truck 4 is provided with an attachment support base 19 which has holding elements 18 for holding the mounting member 9 of the attachment 90 in position. Shown by 3*a*–3*e* are upper dies.

Figure 1:
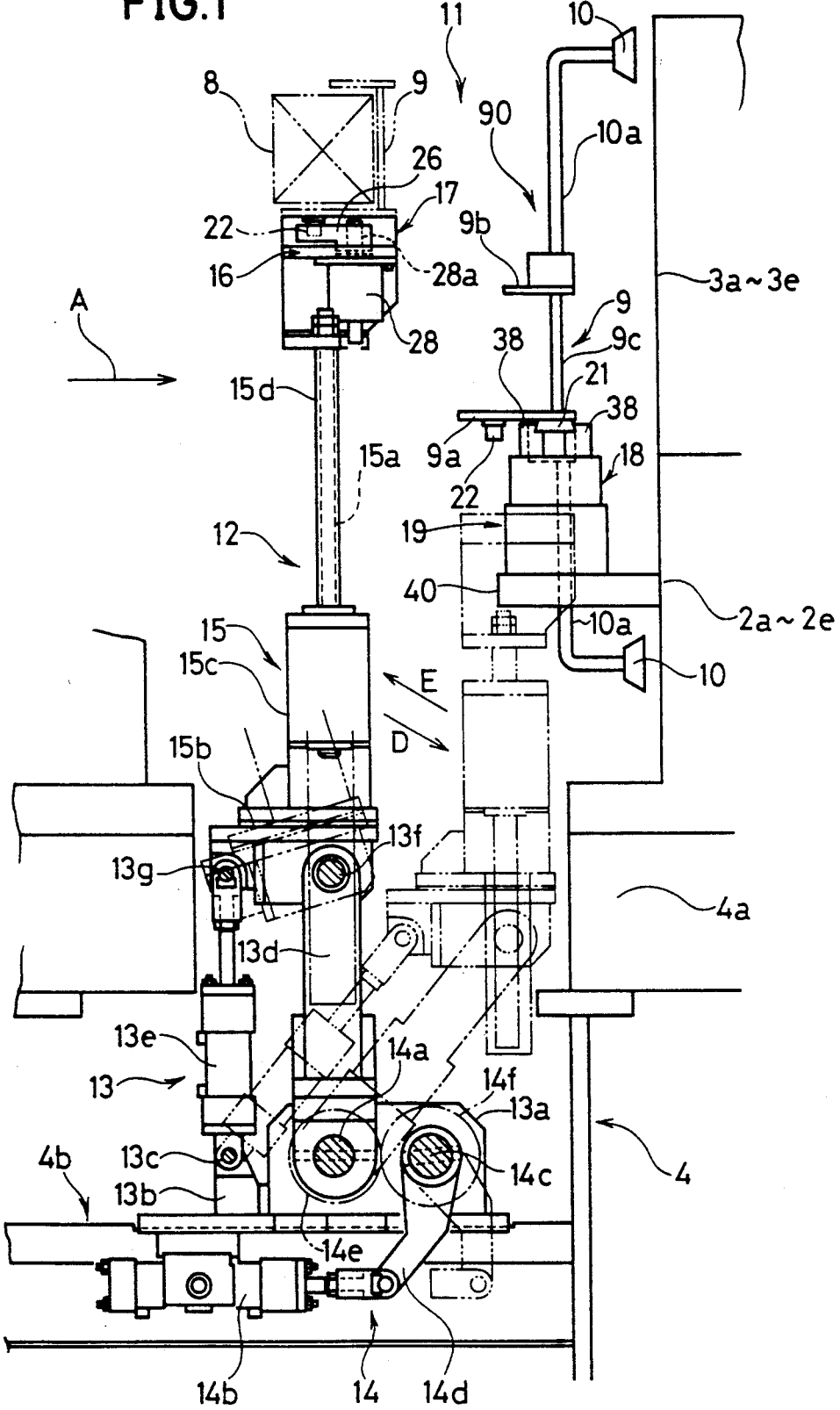
FIG. 1 is a side view of an apparatus for changing workpiece holding attachments which represents one embodiment of the invention.
Figure 2:
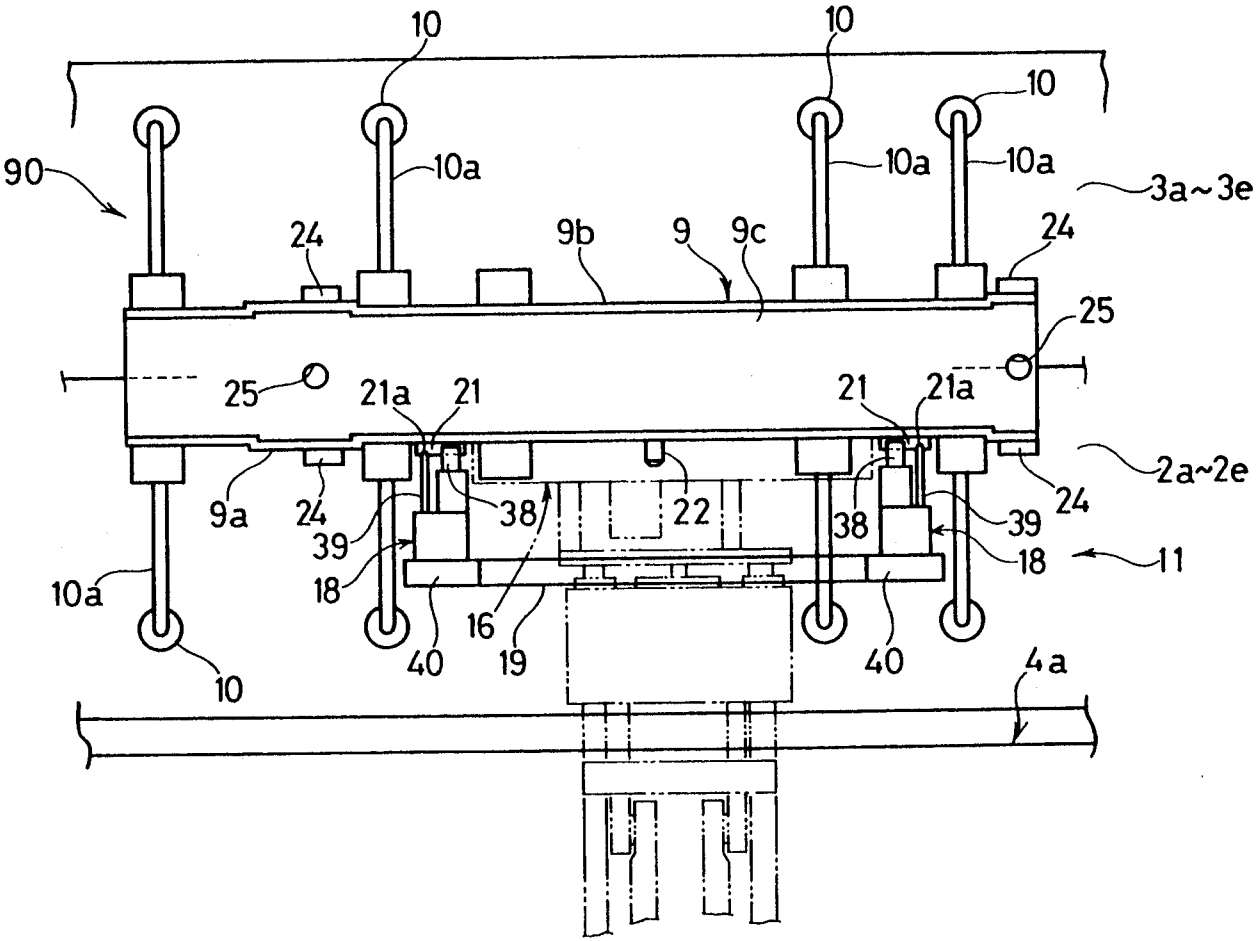
FIG. 2 is a front view showing, together with a workpiece holding attachment, an attachment support base in the apparatus of FIG. 1.
Figure 3:
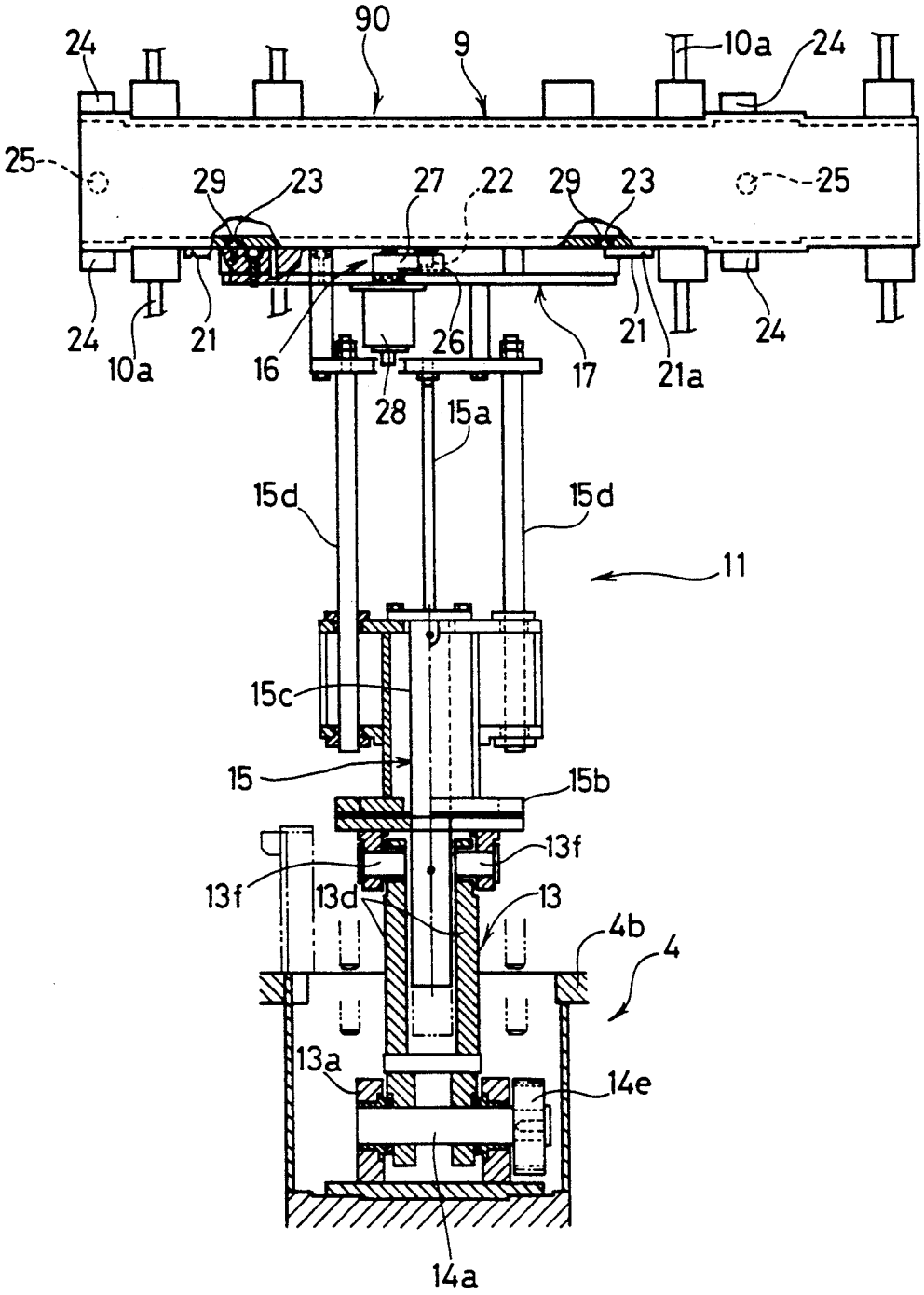
FIG. 3 is a semi-sectional rear view of a movable upright support in the apparatus of FIG. 1.
Figure 5:
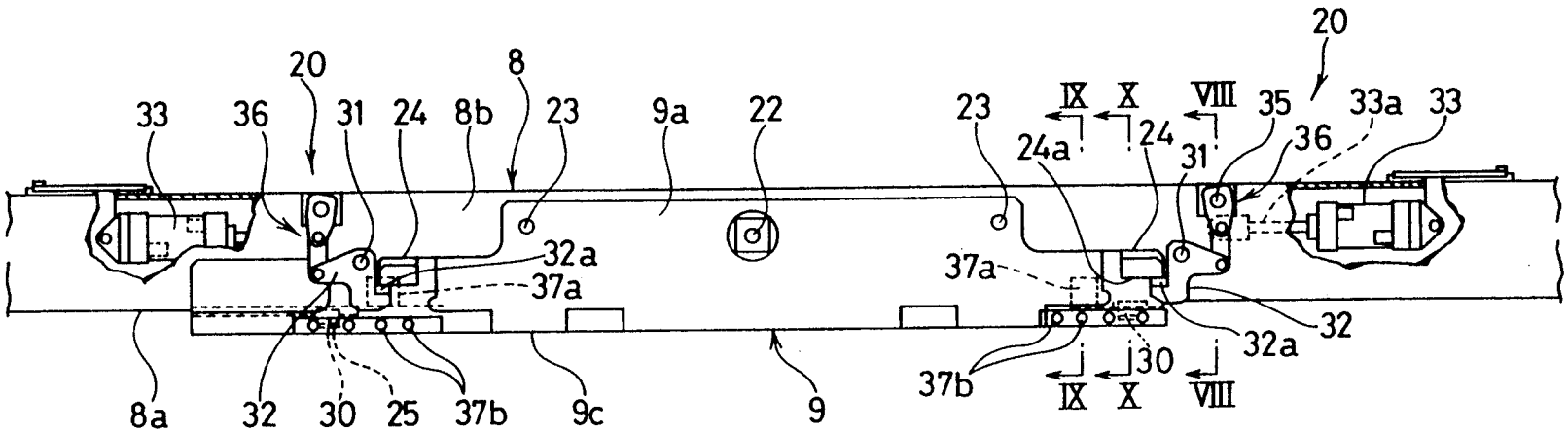
FIG. 5 is a bottom view showing a mounting member for the workpiece holding attachment as secured to a cross-bar.

As FIGS. 1 to 3 show, the mounting member 9 has a sectional configuration of U-shape so that it may be fitted on a corresponding square tube-shaped cross-bar 8, its sides 9*a*, 9*b* being fitted respectively with the suction cups 10 through mounting pipes 10*a*. On side 9*a* is provided a pair of holding blocks 21 in spaced relation as viewed in the longitudinal direction of the mounting member 9. Each of the holding blocks 21 is sectionally configured to be trapezoidal so that it can be held by the holding element 18 of the attachment support base 19, and is formed with a positioning groove 21*a*. On side 9*a* are further provided a clamp pin 22 centrally of the length of the mounting member 9, and location pin holes 23 at both sides of the clamp pin 22 as viewed in the longitudinal direction of the mounting member 9. Clamp pin 22 is designed to be clamped by the holding device 16 of the attachment bearer 17, and the location pin holes 23 are utilized for positioning the attachment 90 on the attachment bearer 17. FIGS. 2, 3 and 5 show, at both ends of the mounting member 9 as viewed in the longitudinal direction thereof are provided clamping abutment members 24 for being clamped by a clamping device 20 provided on the cross-bar 8. The bottom portion 9*c* of the mounting member 9 is formed at the inner side thereof with positioning pin holes 25.

The parallel link mechanism 13 of the movable upright support 12 will be described in detail. In FIGS. 1 and 3, parallel links 13*d* and a link cylinder 13*e* are pivotably mounted respectively to two brackets 13*a* and 13*b* on the base plate 4*b* through a horizontal pin 13*c* and a horizontal shaft 14*a*, both parallel to the cross-bar 8, in spaced relation in the direction of the press line A. The support base 15*b* of the elevating cylinder device 15 is mounted to distal ends of the links 13*d* and link cylinder 13*e* through horizontal pins 13*f*, 13*g*. The body 15*c* of the cylinder device 15 extends vertically from the support base 15*b*. Shown at 15*d* is a guide rod for guiding the attachment bearer 17 for upward and downward movement thereof.

A support shifting device 14 includes a shift cylinder device 14*b* disposed below the base plate 4*b*, the actuating rod of the cylinder device 14*b* being coupled through a pin to a drive lever 14*d* fixed to an interlock shaft 14*c* supported in the bracket 13*a*. Shift gears 14*e* and 14*f*, which are in mesh with each other, are mounted to the horizontal shaft 14*a* and interlock shaft 14*c* respectively, by which arrangement the extending and retracting movement of the shift cylinder device 14 can be converted into pivotal movement of the links 13*d* for reciprocation of the movable upright support 12 in the directions of arrows D and E. The link cylinder 13*e* is so movable as to cause the elevating cylinder device 15 and attachment bearer 17 to be inclined about horizontal pin 13*f* as shown in phantom in FIG. 1, thereby to move them away from upper and lower dies 2*a*–2*e*, 3*a*–3*e*, it being thus possible to prevent the cylinder device 15 and attachment bearer 17 from interfering with die changing operations with respect to the upper and lower dies 2*a*–2*e*, 3*a*–3*e*.

Figure 4:
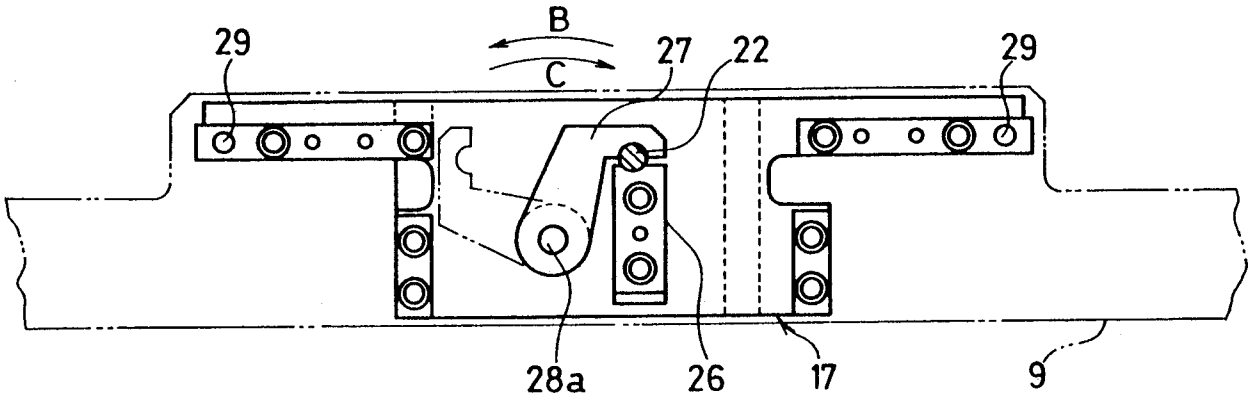
FIG. 4 is a plan view of an attachment bearer in the apparatus of FIG. 1.

As FIG. 4 shows, the attachment bearer 17 is configured to be of T shape in plan view so as not to interfere with components of the mounting member 9. The holding device 16 of the attachment bearer 17 comprises a receiving block 26 for holding a clamp pin 22 centrally of the attachment bearer 17, a holding lever 27 adapted to be opened and closed in the directions of arrows B and C to clamp the clamp pin 22 in cooperation with the receiving block 26, and a holding actuator 28 disposed below the attachment bearer 17 and having an output shaft 28*a* to which is attached the holding lever 27, as shown in FIGS. 1, 3 and 4. The mounting surface of the attachment bearer 17 is formed with location pins 29 which extend upward therefrom for being received into the location holes 23 of the mounting member 9.

Figure 6:
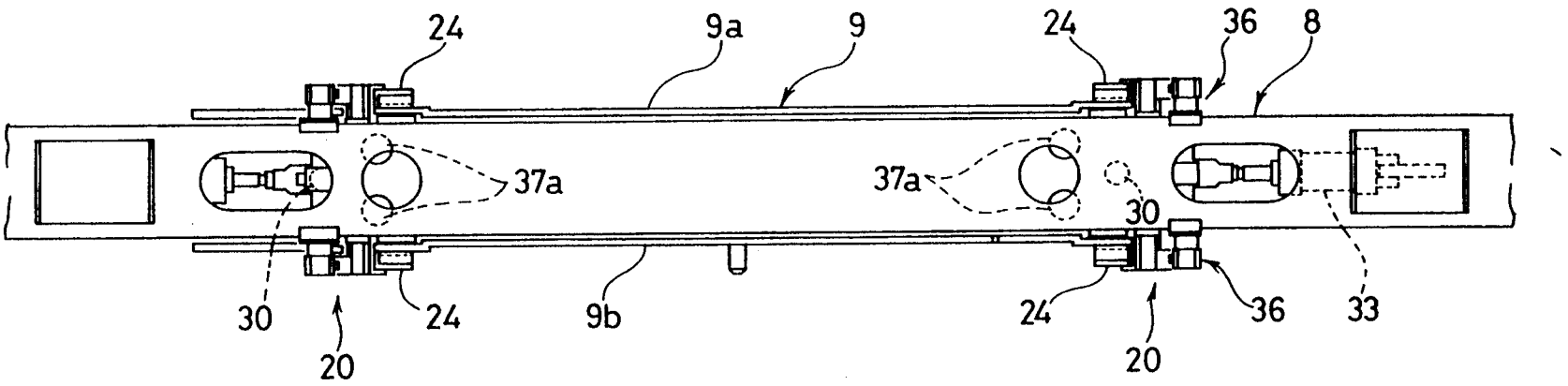
FIG. 6 is a front view of a portion shown in FIG. 5.
Figure 7:
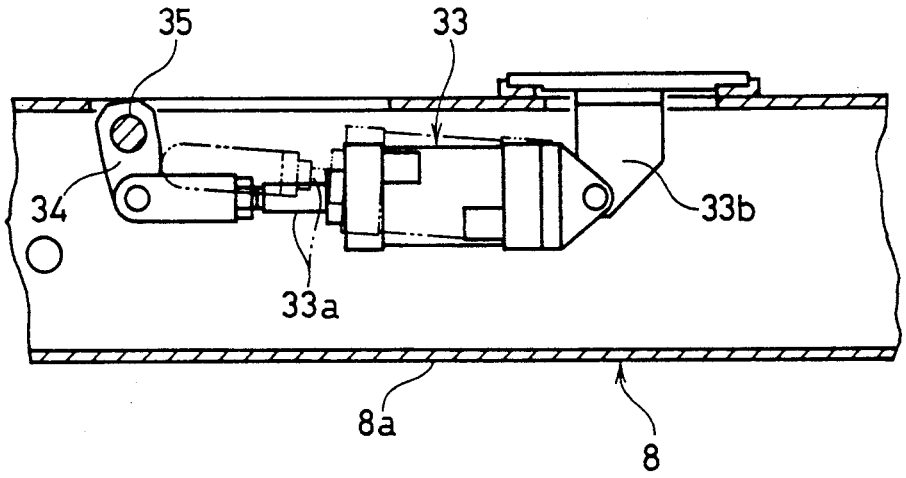
FIG. 7 is a front sectional view showing a device for driving the clamp lever in FIG. 5.
Figure 8:
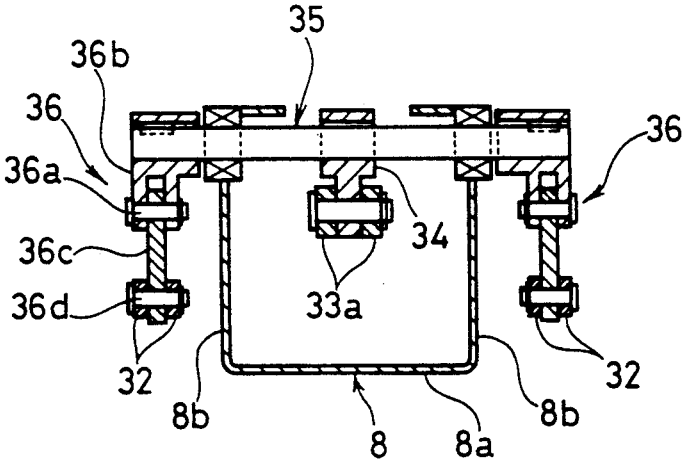
FIG. 8 is a section taken on line VIII—VIII in FIG. 5.
Figure 10:
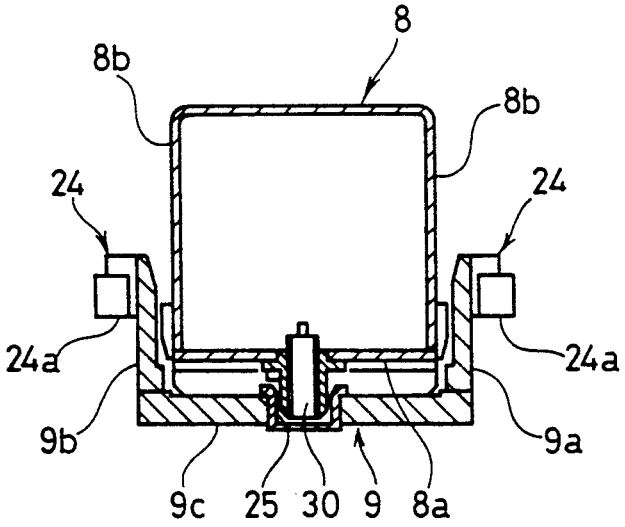
FIG. 10 is a section taken on line X—X in FIG. 5.

As FIGS. 5, 6 and 10 show, a pair of positioning pins 30, for positioning the mounting member 9 in connection with fitting thereof, extend upward from the bottom 8*a* of the cross-bar 8 in spaced relation longitudinally of the cross-bar 8. The positioning pins 30 are received into positioning holes 25 formed in the inner side of the bottom 9*c* of the mounting member 9.

Nextly, the clamp device 20 for clamping the mounting member 9 to the cross-bar 8 will be described in detail. As FIGS. 5, 6 and 10 show, each clamping abutment member 24 of the mounting member 9 has its abutment surface 24*a* formed on the bottom 9*c* side. Clamp levers 32 of L shape which are pivotable about a support pin 31 are provided on opposite sides 8b, 8b of the cross-bar 8 at both ends thereof, each of the clamp levers 32 being provided at one end with a clamp pawl 32a abuttable against the abutment surface 24a of the clamping abutment member 24.

In the interior of each cross-bar 8 there are disposed cylinder devices 33 longitudinally of the cross-bar 8 for pivoting the clamp levers 32. Each of the cylinder devices 33 is supported at its rear end in bracket 33b through a mounting pin, and its actuating rod 33a is connected through a pin to the drive lever 34 of a drive shaft 35 extending through sides 8b, 8b of the cross-bar 8. Two links 36b, 36c are connected between each end of the drive shaft 35 and ends of clamp levers 32 through a center pin 36a and a connecting pin 36d, a toggle link mechanism 36 being thus formed. The drive lever 34 is of substantially same configuration as the link 36b of the drive shaft 35 and is fixed to the drive shaft 35 at same angle.

Therefore, by extending the cylinder device 33 to squeeze bends between links 36b and 36c it is possible to produce a substantially large force at the joint between the link 36c and the clamp lever 32 to pivot the clamp lever 32. Accordingly, the clamp pawl 32a of the clamp lever 32 can be brought into abutment against the abutment surface 24b of the clamping abutment member 24 under considerable clamping force. Furthermore, since cylinder devices 33 are disposed in the interior of each cross-bar 8, and clamp levers 32 are disposed on opposite sides 8b, 8b of the cross-bar 8, and since the cylinder devices 33 and the clamp levers 32 are interlocked together, it is only required that the cross-bar 8 be formed with a through-hole for the drive shaft 35; and this provides for improvement in the rigidity of the cross-bar 8.

Figure 9:
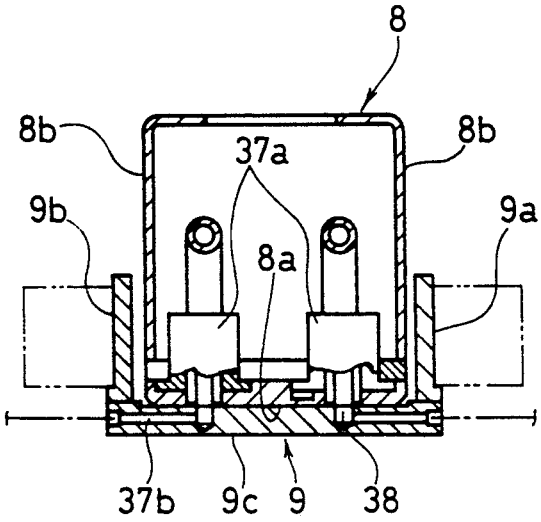
FIG. 9 is a section taken on line IX—IX in FIG. 5.

Since working fluid, such as air of negative pressure, is required as a source of driving force for the suction cups 10, as FIG. 9 shows in detail, automatic piping joints 37a are installed in each cross-bar 8 at opposite positions in case that mounting member 9 is fitted on the cross-bar 8, the mounting member 9 being formed with a connecting hole 37b.

A support block 40 is mounted to the lower die 2a–2e, at the attachment support base 19, as shown in FIGS. 1 and 2. A pair of air chucks 38 and a positioning element 39 extend vertically from each holding element 18, the positioning element 39 being adapted to engage the positioning groove 21a of the holding block 21 to position the mounting member 9, the holding block 21 being firmly held by the air chucks 38.

Nextly, the process of changing the attachments 90 required in conjunction with the die change will be explained with reference to FIGS. 12 through 17.

The dies 2a–2e, 3a–2e and the attachments 90 which have been used are removed by utilizing die change truck. In this case, another die change truck 4 is already positioned outside the press line A, and attachments 90 to be attached to the cross-bars 8 by way of attachment change are supported on respective attachment support bases 19 in the lower dies 2a–2e placed on the other die-change truck 4. In each of the attachments 90, mounting member 9 is already fitted with suction cups 10 in a predetermined manner.

Figure 12:
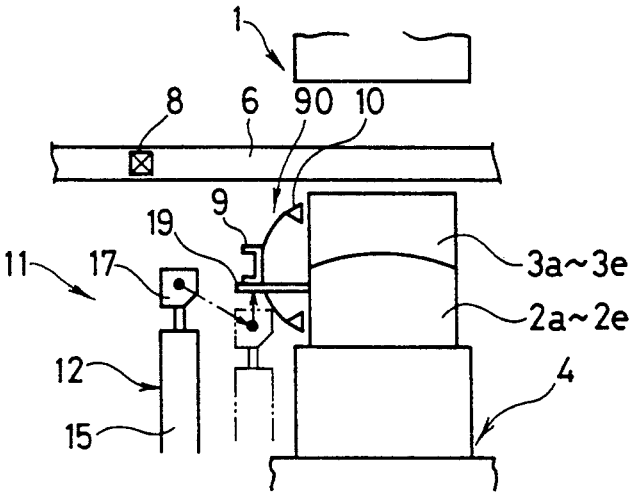
FIGS. 12 to 17 are schematic side views explanatory of various aspects of the process of mounting the workpiece holding attachment to cross-bars.

The die charge truck 4 as prepared in such condition is introduced into the press line A and then the cylinder device 14b of the support shifting device 14 as shown in FIG. 1 is driven to force the movable upright support 12 to make a parallel move to a position below the attachment support base 19. Nextly, the elevating cylinder device 15 is extended to elevate the attachment bearer 17, and the location pin 29 of the attachment bearer 17 is fitted into the location pin hole 23 of the mounting member 9 as shown in FIG. 3, the clamp pin 22 being brought into engagement with the holding recess of the receiving block 26 as shown in FIG. 4. The holding actuator 28 is driven to move the holding lever 27 to its closed position, and the clamp pin 22 is thus nipped between the holding lever 27 and the receiving block 26, whereby the mounting member 9 is firmly held by the attachment bearer 17 (FIG. 12).

Figure 13:
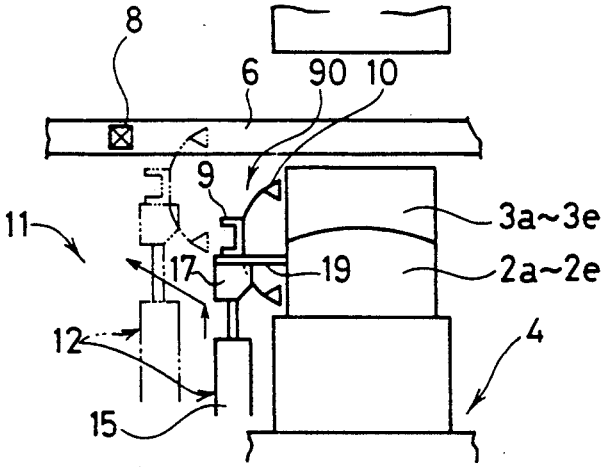
Figure 14:
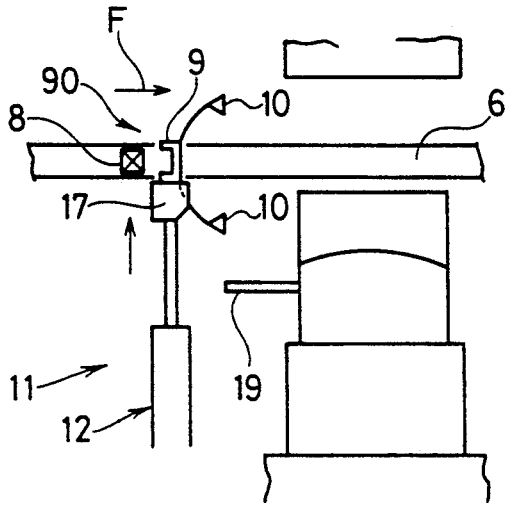

On the attachment support base 19 side, the air chuck 38 of the holding element 18 is opened and the cylinder device 15 is further extended, the attachment 90 being lifted from the attachment support base 19 (FIG. 13). The shift cylinder device 14b is driven to cause the attachment 90 to be carried away from the attachment support base 19, and the elevating cylinder device 15 is further extended to elevate the mounting member 9 of the attachment 90 to a position opposite to the cross-bar 8 (FIG. 14).

Figure 15:
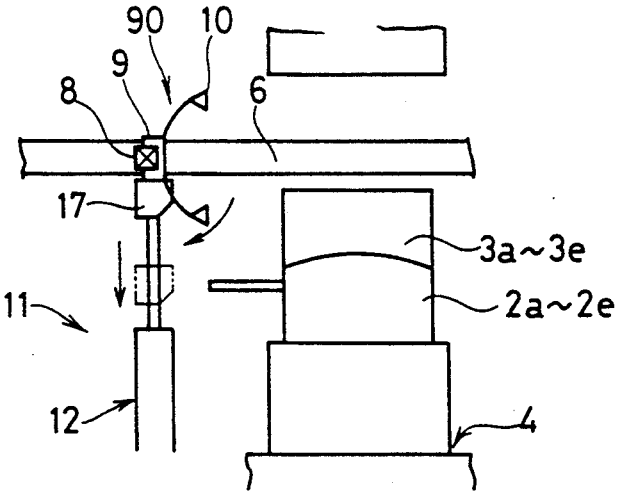

Subsequently, the feed bars 6 are shifted in the direction of arrow F and the cross-bar 8 is fitted in the mounting member 9. Thereupon, the positioning pin 30 of the cross bar 8 fits into the positioning pin hole 25 of the mounting member 9 so that the attachment 90 is positioned. The clamp lever 32 is pivoted by the clamp lever drive cylinder device 33 in the cross-bar 8 through the toggle link mechanism 36 so that the clamp pawl 32a is brought into abutment against the abutment surface 24a of the clamping abutment member 24, the mounting member 9 of the attachment 90 being thus firmly fixed to the cross-bar 8 (FIG. 15).

Thereafter, the holding actuator 28 of the attachment bearer 17 is driven to move the holding lever 27 to its open position to release the clamp pin 22, whereby the attachment bearer 17 and the attachment 90 are separated from each other. In that condition, the elevating cylinder 15 is contracted to lower the attachment bearer 17 so that the attachment bearer 17 is held away from the attachment 90.

Figure 16:
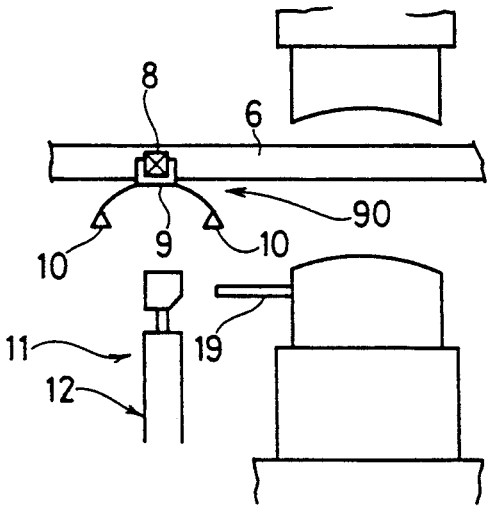
Figure 17:
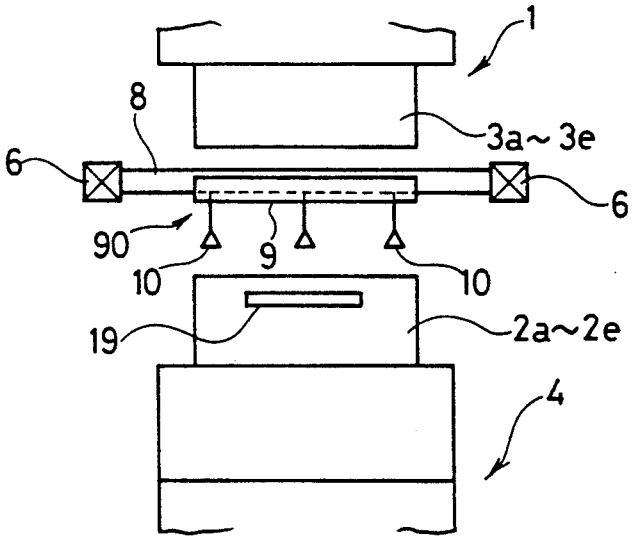

Subsequently, the cross-bar 8 is rotated 90 degrees about its axis to orient the suction cups 10 downward, the suction cups 10 being thus enabled to hold the workpiece in position (FIGS. 16, 17).

When needs for die change arise again, the attachments 90 may be removed by the reverse of to the foregoing sequence.

What is claimed is:

1. A workpiece holder changing apparatus in a transfer press, said transfer press including a die change truck movable between a press line and a location external thereof while being loaded with die means, a cross-bar mounted to feed bars shiftable along the press line, and a workpiece holder mounted to the cross-bar, said changing apparatus comprising:

a workpiece holding attachment including workpiece holding means and a mounting member to which the workpiece holding means is mounted;

an attachment support base provided on said die means for supporting said mounting member of said workpiece holding attachment;

a movable upright support disposed on said die change truck and movable between a position corresponding to said attachment support base and a position corresponding to said cross-bar;

an attachment bearer mounted to the movable upright support at a top end portion thereof; and means provided on said attachment bearer for holding said workpiece holding attachment in position on said attachment bearer.

2. A workpiece holder changing apparatus in a transfer press as set forth in claim 1, wherein said attachment support base and said attachment bearer have, respectively, means for positioning the mounting member and means for clamping the mounting member.

3. A workpiece holder changing apparatus in a transfer press as set forth in claim 1, wherein:

said attachment support base and said cross-bar are arranged in spaced relation in both horizontal and vertical directions;

said movable upright support is vertically disposed;

said changing apparatus has means for forcing said movable upright support to make a parallel move within a vertical plane; and said movable upright support is longitudinally extentable and contractable.

4. A workpiece holder changing apparatus in a transfer press as set forth in claim 3, wherein said movable upright support comprises cylinder means.

5. A workpiece holder changing apparatus in a transfer press as set forth in claim 3, further comprising means for tilting the movable upright support to prevent both the movable upright support and the attachment bearer from interfering with the die means during the process of die change.

6. A workpiece holder changing apparatus in a transfer press as set forth in claim 1, further comprising means for positioning the attachment relative to the cross-bar, and means for clamping the attachment relative to the cross-bar.

7. A workpiece holder changing apparatus in a transfer press as set forth in claim 6, wherein the positioning means include projection means formed on one of the attachment and cross-bar, and recess means formed in the other for receiving said projection means.

8. A workpiece holder changing apparatus in a transfer press as set forth in claim 6, wherein the attachment has clamping abutment means and wherein the cross-bar has clamp lever means engageable with said clamping abutment means.

9. A workpiece holder changing apparatus in a transfer press as set forth in claim 8, further comprising drive means for actuating the clamp lever means through toggle link means.

10. A workpiece holder changing apparatus in a transfer press as set forth in claim 8, wherein:

the cross-bar is square tube-shaped, the mounting member of the attachment is configured to be of U-shaped section such that it can be fitted on said cross-bar, and has a pair of sides corresponding to the U-shape, the locking abutment means comprise locking abutment members provided on opposite sides of the mounting member at both ends thereof, and the clamp lever means comprise clamp levers in corresponding relation to the locking abutment members.

11. A workpiece holder changing apparatus in a transfer press as set forth in claim 10, wherein the cross-bar is rotatable about its axis.

12. A workpiece holder changing apparatus in a transfer press as set forth in claim 1, wherein:

the work holding means of the attachment is operable with working fluid, and said holder changing apparatus includes:

piping means for said working fluid provided in the cross-bar, and means for communicating said piping means with the attachment.

* * * * *

UNITED STATES PATENT AND TRADEMARK OFFICE

CERTIFICATE OF CORRECTION

PATENT NO. : 5,248,288

DATED : September 28, 1993

INVENTOR(S) : Fujimaro Kamiya et al.

It is certified that error appears in the above-identified patent and that said Letters Patent is hereby corrected as shown below:

On the Title Page, Item [57], line 19, "work" should read --workpiece--

Column 5, line 64, "charge" should read --change--

Column 7, line 21, correct spelling of --extendable--

Signed and Sealed this

Tenth Day of May, 1994

Bruce Lehman

*Attest:*

BRUCE LEHMAN

*Attesting Officer*

*Commissioner of Patents and Trademarks*